US009349554B2

(12) United States Patent
Ohda et al.

(10) Patent No.: US 9,349,554 B2
(45) Date of Patent: May 24, 2016

(54) SWITCHGEAR AND SWITCHGEAR OPERATING MECHANISM

(71) Applicant: Kabushiki Kaisha Toshiba, Minato-ku (JP)

(72) Inventors: Yoshiaki Ohda, Yokohama (JP); Tatsuya Watanabe, Musashimurayama (JP); Yoshikata Kobayashi, Hachioji (JP); Masaharu Shimizu, Yokohama (JP); Satoshi Marushima, Kawasaki (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 154 days.

(21) Appl. No.: 14/291,580

(22) Filed: May 30, 2014

(65) Prior Publication Data

US 2014/0262714 A1 Sep. 18, 2014

Related U.S. Application Data

(63) Continuation of application No. PCT/JP2012/008328, filed on Dec. 26, 2012.

(30) Foreign Application Priority Data

Jan. 11, 2012 (JP) ..... 2012-003280

(51) Int. Cl.
*H01H 5/00* (2006.01)
*H01H 21/48* (2006.01)
(Continued)

(52) U.S. Cl.
CPC ..... *H01H 21/48* (2013.01); *H01H 3/34* (2013.01); *H01H 3/36* (2013.01); *H01H 3/42* (2013.01); *H01H 3/58* (2013.01); *H01H 71/70* (2013.01); *H01H 7/03* (2013.01); *H01H 2227/034* (2013.01)

(58) Field of Classification Search
CPC ..... H01H 21/48; H01H 71/70; H01H 3/00; H01H 3/02; H01H 3/22; H01H 3/227; H01H 3/3042; H01H 3/3052; H01H 3/32; H01H 3/36; H01H 3/38; H01H 3/40; H01H 3/42; H01H 3/44; H01H 3/46; H01H 3/54; H01H 9/0005; H01H 9/0027; H01H 33/36; H01H 33/40; H01H 33/42; H01H 2003/00; H01H 2003/02; H01H 2003/32; H01H 2003/326; H01H 2003/40; H01H 2003/46; H01H 1/26; H01H 5/00; H01H 2025/00; H01H 2025/002; H01H 2207/03; H01H 7/03
USPC ..... 200/5 B, 43.16, 50.16, 50.17, 50.21, 200/50.24, 50.27, 50.3, 50.32, 50.39, 50.4, 200/431, 318, 318.1, 320, 324, 400, 43.01
See application file for complete search history.

(56) References Cited

U.S. PATENT DOCUMENTS 4,237,357 A * 12/1980 Opfer ..... 200/400
5,222,327 A * 6/1993 Fellows et al. ..... 49/139
6,066,820 A * 5/2000 Niklaus ..... 200/501

FOREIGN PATENT DOCUMENTS

BE 696.042 A 9/1967
FR 708.402 A 7/1931
(Continued)

OTHER PUBLICATIONS

Extended European Search Report issued Aug. 28, 2015 in Patent Application No. 12865117.1.
(Continued)

*Primary Examiner* — Renee Luebke
*Assistant Examiner* — Anthony R. Jimenez
(74) *Attorney, Agent, or Firm* — Oblon, McClelland, Maier & Neustadt, L.L.P

(57) ABSTRACT

A switchgear operating mechanism has: a ratchet wheel that rotates together with a closing shaft; a stop lever that enables contact between an energy storing cam and a roller; a motor that transmits power to a feed lever; a feed pawl; stop pawls that suppresses reverse rotation of the feed pawl; a closing lever that expands/contracts a closing spring; a catch mechanism for energy storage for the closing lever; a closing cam; a stopper unit that suppresses rotation of the stop lever; a first sprocket; second and third sprockets that are capable of rotating together with an intermediate shaft; a fourth sprocket rotatably fastened to an energy storing cam shaft; a first chain that engages with the first and second sprockets; and a second chain that engages with the third and fourth sprockets.

10 Claims, 6 Drawing Sheets

(51) Int. Cl.

| | |
|---|---|
| ***H01H 3/34*** | (2006.01) |
| ***H01H 3/58*** | (2006.01) |
| ***H01H 3/36*** | (2006.01) |
| ***H01H 3/42*** | (2006.01) |
| ***H01H 71/70*** | (2006.01) |
| *H01H 7/03* | (2006.01) |

(56) References Cited

FOREIGN PATENT DOCUMENTS

| | | | |
|---|---|---|---|
| JP | 01-307123 | A | 12/1989 |
| JP | 05-266764 | A | 10/1993 |
| JP | 2007-188775 | A | 7/2007 |
| JP | 2007-294363 | A | 11/2007 |
| JP | 2011-060571 | A | 3/2011 |

OTHER PUBLICATIONS

"Chains for Power Transmission and Material Handling" Standard Handbook of Chains, American Chain Association, XP055207935, 2006, pp. 129-175 (with cover pages).

"The Complete Guide to Chain" U.S. Tsubaki, Inc., Retrieved from the Internet [http://www.ustsubaki.com/pdf/The%20Chain%20Book%20Catalog_small.pdf] XP055207930, 1997, 255 Pages.

International Search Report Issued on Jan. 29, 2013 for PCT/JP2012/008328 Filed on Dec. 26, 2012 with English Translation.

* cited by examiner

SWITCHGEAR AND SWITCHGEAR OPERATING MECHANISM

CROSS REFERENCES TO RELATED APPLICATIONS

This application is a continuation-in-part (CIP) application based upon the International Application PCT/JP2012/008328, the International Filing Date of which is Dec. 26, 2012, the entire content of which is incorporated herein by reference, and is based upon and claims the benefit of priority from the prior Japanese Patent Application No. 2012-003280, filed in the Japanese Patent Office on Jan. 11, 2012, the entire content of which is incorporated herein by reference.

FIELD

The present embodiments relate to a switchgear and a switchgear operating mechanism.

BACKGROUND

Generally, in a closing device of an operating mechanism of a switchgear, a feed pawl is rolled by rotation of a motor to rotate a ratchet wheel, the rotating ratchet wheel rotates a closing shaft to store energy in a closing spring through a closing lever, and releasing the energy of the closing spring in an energy-stored state allows closing operation of the switchgear to be achieved.

As a first conventional example of such an operating mechanism of the switchgear, there is known a technology disclosed in Patent Document 1. In the technology of Patent Document 1, a closing shaft is restrained from being rotated reversely immediately after closing operation of the switchgear mechanism by a cam clutch as well as by first to third pawls, thereby dispersing and lessening impact force caused at leading ends of the pawls and at leading ends of engaging teeth of a wheel.

Further, as a second conventional example of the switchgear operating mechanism, there is known a technology disclosed in Patent Document 2. The technology of Patent Document 2 discloses a structure in which a stop lever engaged with a first plate swings about a closing shaft since a non-linear elastic member is provided in a stopper unit for first and second stop pawls and in which a power transmission section that drives an energy storing cam rotatably mounted to a stop lever can transmit motor drive force even when a distance between a reduction gear and the energy storing cam changes.

Further, as a third conventional example of the switchgear operating mechanism, there is known a technology disclosed in Patent Document 3. In the technology of Patent Document 3, a power transmission mechanism is constituted by a chain and a sprocket, and the power transmission mechanism using the chain can transmit power even if an inter-axis distance between the sprockets disposed at both ends of the chain is increased/decreased to a certain degree.

The patent documents cited above are as follows:

Patent Document 1: Japanese Patent Application Laid-Open Publication No. 2007-188775

Patent Document 2: Japanese Patent Application Laid-Open Publication No. 2011-60571

Patent Document 3: Japanese Patent Application Laid-Open Publication No. 2007-294363

In the above-described first conventional example, sometimes the reverse rotation of a ratchet wheel at closing operation time is stopped by the first pawl. In this case, impact force at the stop time is received by the first pawl, a cam roller, an energy storing cam, a stopper, and the cam clutch. This may cause breakage and reduction in lifetime of components that receive such impact force.

Further, in the second conventional example, the reverse rotation of the ratchet wheel at closing operation time is stopped by the first stop pawl or the second stop pawl, and the impact force generated at that time is absorbed by elastic deformation of the non-linear elastic member of the stopper unit, with the result that a peak load of the non-linear elastic member increases with the displacement. Thus, it is necessary to increase strength of a member supporting the stopper unit in accordance with the peak load, so that the operation mechanism tends to increase in size. Further, in order to absorb the impact force while reducing the peak load, it is necessary to increase the displacement (deformation amount) of the non-linear elastic member. However, the larger the displacement, the larger a swing angle of the stop lever, and the larger the displacement of the sprocket, resulting in increase in slack of the chain. This increases a possibility that the chain may drop out of the sprockets, as well as, a possibility that the chain may be vibrated significantly to come into contact with other components to be damaged.

Further, in the third conventional example, when the inter-axis distance between the sprockets disposed at both ends of the chain as the power transmission mechanism is increased/decreased to a certain degree, there are increased possibilities that the chain may drop out of the sprockets and that the chain may be vibrated significantly to come into contact with other components to be damaged.

DETAILED DESCRIPTION

Figure 1:
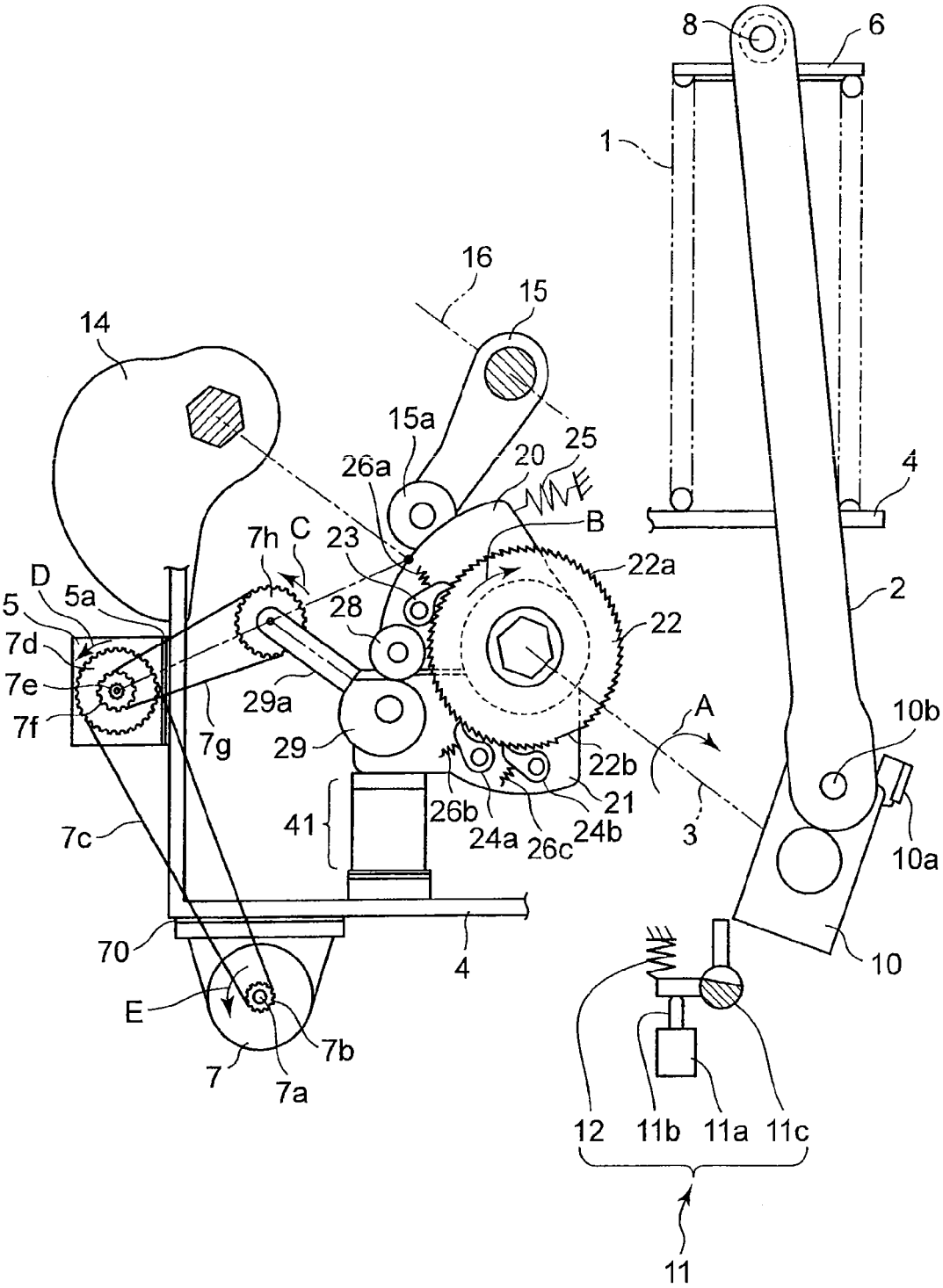
FIG. 1 is a developed front view illustrating a closing operation completion state of a switchgear operating mechanism according to a first embodiment of the present invention.

An object of the present embodiments is to provide a switchgear and a switchgear operating mechanism capable of lessening impact force caused when the ratchet wheel is reversely rotated at closing operation time to prevent a reduction in strength of a support member to thereby prevent drop-out of the chain.

In order to solve the problems described above, according to an embodiment, there is presented a switchgear operating mechanism for reciprocatively driving a movable contact of a switchgear so as to shift the switchgear between a cutoff state and a closed state, the switchgear operating mechanism comprising: a support structure; a closing shaft extending in a first rotation axis direction to be rotatably supported by the support structure; a ratchet wheel having substantially a disk-like shape, having a plurality of outer peripheral teeth formed along an outer peripheral side surface thereof and fixed to the closing shaft to be rotated together with the closing shaft; a feed lever having a plate-like shape, juxtaposed to the ratchet wheel in an axial direction thereof so as to be swingable about the closing shaft in a peripheral direction and provided with, near an outer periphery thereof, a feed lever roller rotatable about a second rotation axis extending in parallel to the closing shaft; a stop lever having a plate-like shape, juxtaposed to the feed lever in the first rotation axis direction so as to be swingable about the closing shaft in a peripheral direction and provided with, near an outer periphery thereof, an energy storing cam rotatable about an energy storing cam shaft extending in parallel to the closing shaft, the energy storing cam being contactable with a periphery of the feed lever roller; a motor fixed to the support structure and configured to transmit power for swinging the feed lever; a feed pawl fixed to the feed lever so as to be engageable with the outer peripheral teeth and configured to transmit the power from the motor to the ratchet wheel to rotate the ratchet wheel and the closing shaft in at least one direction; a plurality of stop pawls fixed to the stop lever and engaged with the ratchet wheel so as to prevent the ratchet wheel and the closing shaft from being rotated in a reverse direction to the one direction; a closing spring configured to be expanded/contracted with rotation of the closing shaft; a closing lever fixed to the closing shaft and configured to have the closing spring expand/contract by rotation of the closing shaft; a catch mechanism configured to maintain an energy storing state of the closing spring; a closing cam fixed to the closing shaft to be rotated together with the closing shaft; a first sprocket fixed to an output shaft of the motor; a sprocket base fixed to the support structure; an intermediate shaft rotatably supported by the sprocket base; a second sprocket fixed to the intermediate shaft so as to be rotatable together with the intermediate shaft; a third sprocket fixed to the intermediate shaft so as to be rotatable together with the intermediate shaft; a fourth sprocket rotatably fixed to the energy storing cam shaft; a first chain meshed with the first and the second sprockets; and a second chain meshed with the third and the fourth sprockets.

In order to solve the problems described above, according to an embodiment, there is presented a switchgear comprising: a movable contact that can be moved in a reciprocating manner, and an operating mechanism that reciprocatively drives the movable contact and configured to be shifted between a cutoff state and a closed state by the movement of the movable contact, the operating mechanism including: a support structure; a closing shaft extending in a first rotation axis direction to be rotatably supported by the support structure; a ratchet wheel having substantially a disk-like shape, having a plurality of outer peripheral teeth formed along an outer peripheral side surface thereof and fixed to the closing shaft to be rotated together with the closing shaft; a feed lever having a plate-like shape, juxtaposed to the ratchet wheel in an axial direction thereof so as to be swingable about the closing shaft in a peripheral direction and provided with, near an outer periphery thereof, a feed lever roller rotatable about a second rotation axis extending in parallel to the closing shaft; a stop lever having a plate-like shape, juxtaposed to the feed lever in the first rotation axis direction so as to be swingable about the closing shaft in a peripheral direction and provided with, near an outer periphery thereof, an energy storing cam rotatable about an energy storing cam shaft extending in parallel to the closing shaft, the energy storing cam being contactable with a periphery of the feed lever roller; a motor fixed to the support structure and configured to transmit power for swinging the feed lever; a feed pawl fixed to the feed lever so as to be engageable with the outer peripheral teeth and configured to transmit the power from the motor to the ratchet wheel to rotate the ratchet wheel and the closing shaft in at least one direction; a plurality of stop pawls fixed to the stop lever and engaged with the ratchet wheel so as to prevent the ratchet wheel and the closing shaft from being rotated in a reverse direction to the one direction; a closing spring configured to be expanded/contracted with rotation of the closing shaft; a closing lever fixed to the closing shaft and configured to have the closing spring expand/contract by rotation of the closing shaft; a catch mechanism configured to maintain an energy storing state of the closing spring; a closing cam fixed to the closing shaft to be rotated together with the closing shaft; a first sprocket fixed to an output shaft of the motor; a sprocket base fixed to the support structure; an intermediate shaft rotatably supported by the sprocket base; a second sprocket fixed to the intermediate shaft so as to be rotatable together with the intermediate shaft; a third sprocket fixed to the intermediate shaft so as to be rotatable together with the intermediate shaft; a fourth sprocket rotatably fixed to the energy storing cam shaft; a first chain meshed with the first and the second sprockets; and a second chain meshed with the third and the fourth sprockets.

Embodiments of a switchgear operating mechanism according to the present invention will be described below with reference to the drawings.

First Embodiment

Figure 2:
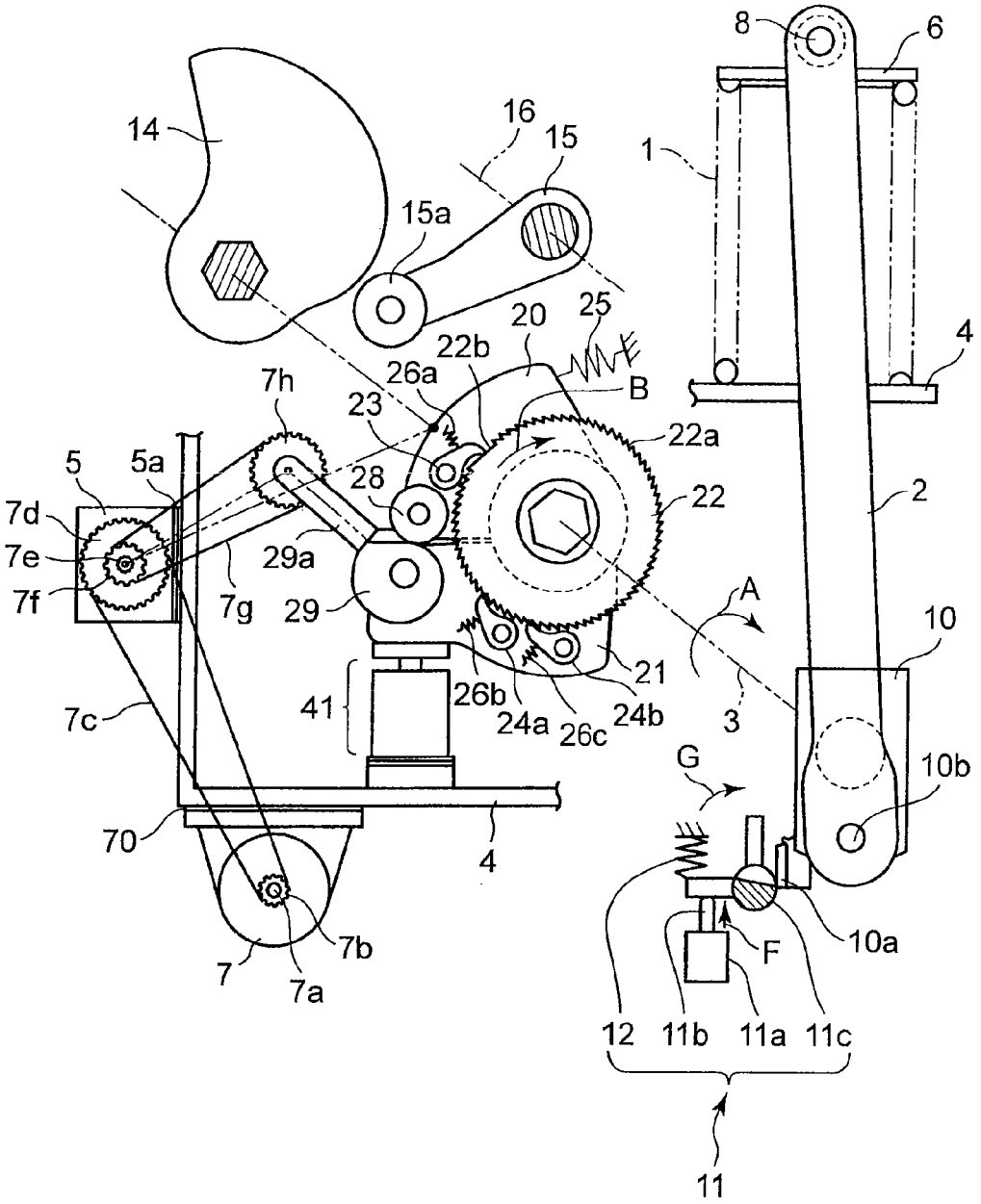
FIG. 2 is a developed front view illustrating an energy storage completion state of the switchgear operating mechanism according to the first embodiment of the present invention.
Figure 3:
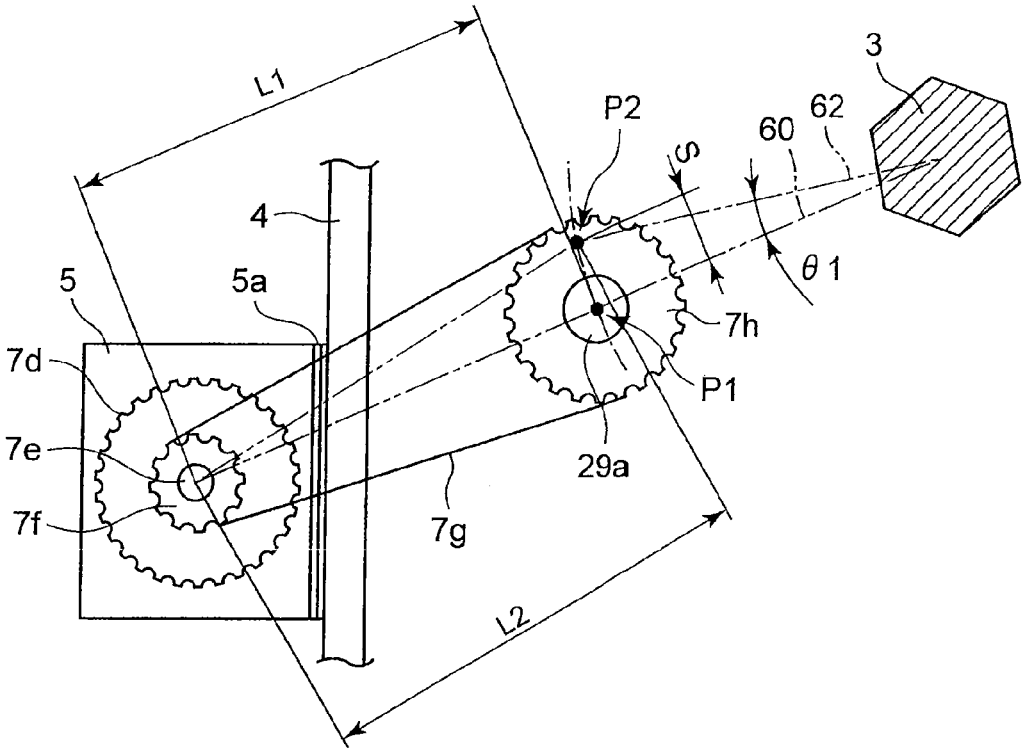
FIG. 3 is a view illustrating a closing shaft, a fourth sprocket and an intermediate shaft part which are illustrated in FIGS. 1 and 2.
Figure 4:
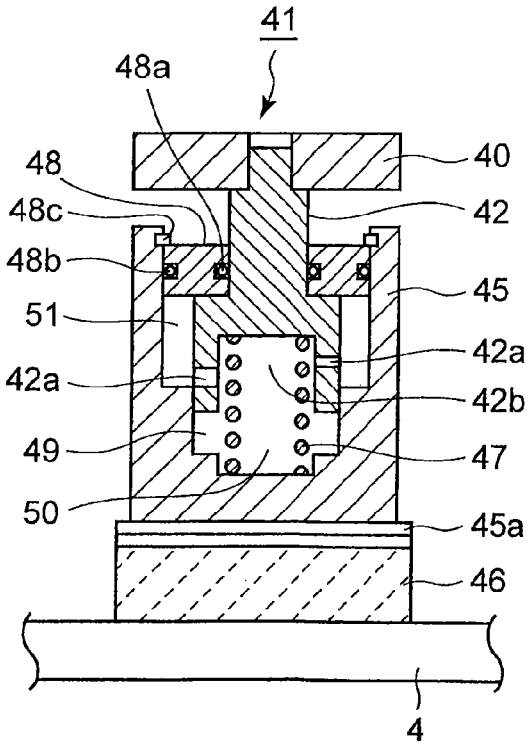
FIG. 4 is a cross-sectional view of a stopper unit of the operating mechanism illustrated in FIG. 2.
Figure 5:
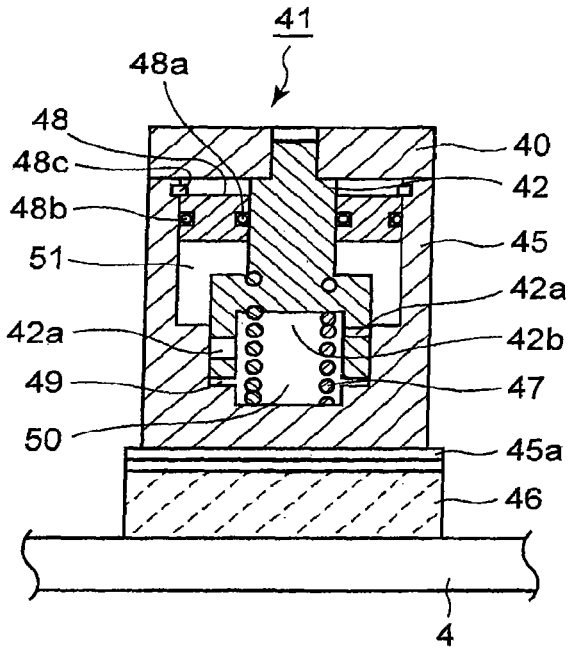
FIG. 5 is a cross-sectional view of the stopper unit of the operating mechanism illustrated in FIG. 1.
Figure 6:
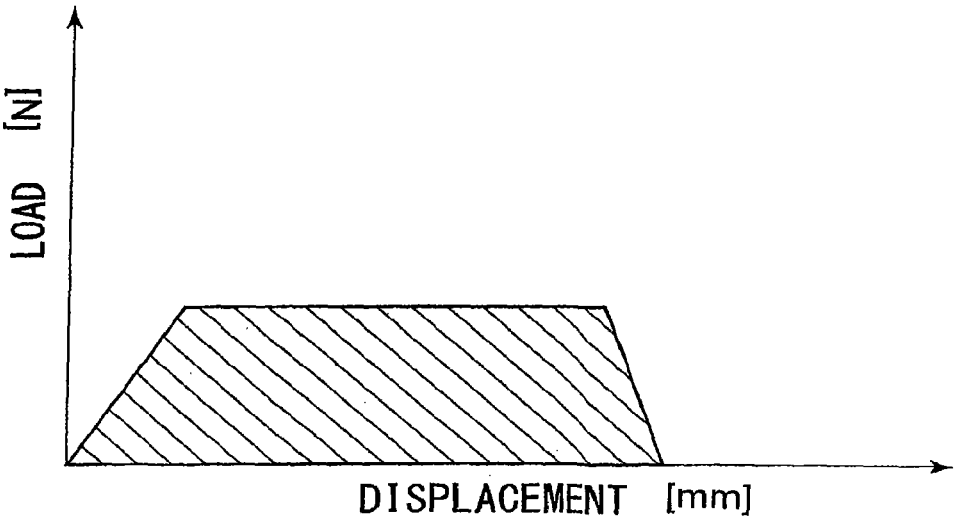
FIG. 6 is a graph illustrating a relationship between the displacement of the stopper unit and the load thereon in the first embodiment.
Figure 9:
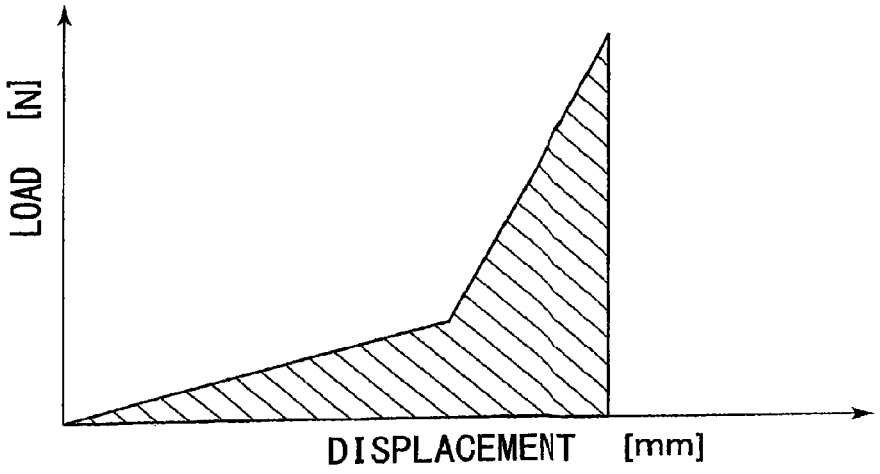
FIG. 9 is a view illustrating a relationship between the displacement of the stopper unit and the load thereon in a conventional example.

With reference to FIGS. 1 to 6, a first embodiment of a switchgear operating mechanism according to the present invention will be described. FIG. 1 is a developed front view illustrating a closing operation completion state of the switchgear operating mechanism according to the first embodiment of the present invention. FIG. 2 is a developed front view illustrating an energy storage completion state of the switchgear operating mechanism according to the first embodiment. FIG. 3 is a view illustrating a closing shaft illustrated in FIGS. 1 and 2, a fourth sprocket, and an intermediate shaft part. FIG. 4 is a cross-sectional view of a stopper unit of the operating mechanism illustrated in FIG. 2, and FIG. 5 is a cross-sectional view of the stopper unit of the operating mechanism illustrated in FIG. 1. FIG. 6 illustrates a relationship between displacement of the stopper unit and a load thereon. FIG. 9 illustrates a relationship between displacement of the stopper unit and a load thereon in a conventional example, which is exemplified for comparison with FIG. 6.

Prior to description of a configuration of the switchgear operating mechanism of the first embodiment, a configuration of a typical switchgear will be described. In the configuration of a switchgear according to the present embodiment, components such as an opening spring and a catch device part provided in a typical switchgear are illustrated in a simplified manner or illustration thereof is omitted. Further, in the configuration of the switchgear operating mechanism according to the present embodiment illustrated in FIGS. 1 and 2, a closing shaft 3 is illustrated only in a portion of its shaft center, and details thereof, such as the entire shape, are omitted.

First, a configuration of the switchgear operating mechanism will be described.

As illustrated in FIGS. 1 and 2, the switchgear operating mechanism according to the present embodiment has a support structure 4, and a closing shaft 3 extends in an axial direction to be rotatably supported by the support structure 4.

A ratchet wheel 22 rotated together with the closing shaft 3 is fixed to the closing shaft 3. The ratchet wheel 22 is disposed spaced apart from a closing lever 10 in the axial direction of the closing shaft 3. The ratchet wheel 22 has a disk shape, and a plurality of outer peripheral teeth 22*a* are formed on an outer peripheral side surface thereof.

The closing lever 10 is fixed to the closing shaft 3. When the closing lever 10 reaches a position (dead center) illustrated in FIG. 2, that is, a position at which a distance between the support structure 4 and a spring receiver 6 or a pin 8 becomes minimum, storage of energy in a closing spring 1 is completed.

The closing lever 10 at the dead center illustrated in FIG. 2 is further rotated by inertial force of the closing spring 1, the closing lever 10, the ratchet wheel 22, and a closing cam 14 in a direction of an arrow A. The closing spring 1 is energy stored once again by this rotation as illustrated in FIG. 2. In this state, rotation speed of the closing lever 10 is reduced to zero while storing energy in the closing spring 1.

After that, the closing lever 10 is rotated in a direction opposite to the arrow A by spring force (restoring force) of the energy-stored closing spring 1. At this time, the ratchet wheel 22 is also rotated in the direction opposite to the arrow A. The reverse rotation of the ratchet wheel 22 is stopped by engagement of at least one of a first stop pawl 24*a* and a second stop pawl 24*b* with the outer peripheral teeth 22*a*. Alternatively, there may be a case where a feed pawl 23 and the outer peripheral teeth 22*a* are engaged with each other to stop the reverse rotation of the ratchet wheel 22.

A pawl 10*a* is firmly fixed to a leading end of the closing lever 10, and the pawl 10*a* is engaged with an engagement lever 11*c* having a crescent-shaped cross section. FIG. 2 illustrates a state where the pawl 10*a* and the engagement lever 11*c* are engaged with each other.

The feed lever 20 is rotatably mounted to the closing shaft 3, and the spring force, which is rotational force in the direction opposite to the arrow A, is always applied to the feed lever 20 by a return spring 25.

A roller 28 is disposed around an outer periphery of the feed lever 20. The roller 28 can be rotated about its shaft extending in parallel to the closing shaft 3. The roller 28 is engaged with an energy storing cam 29 to restrict rotation of the feed lever 20. Spring force is always applied to the feed lever 20 by the return spring 25 in the direction opposite to the arrow A of FIG. 1 so as to rotate the feed lever 20 about the closing shaft 3.

A stop lever 21 is rotatably mounted to the closing shaft 3. The energy storing cam 29 is disposed around an outer periphery of the stop lever 21.

The energy storing cam 29 can be rotated about its shaft (energy storing cam shaft 29*a*) extending in parallel to the closing shaft 3. The roller 28 mounted to the feed lever 20 and the energy storing cam 29 mounted to the stop lever 21 can be brought into contact with each other in a peripheral direction. The energy storing cam 29 is engaged with the roller 28 rotatably mounted to the feed lever 20. An energy storing cam shaft 29*a* for transmitting drive force of a motor 7 (electric motor) is firmly fixed to the energy storing cam 29.

In FIG. 1, a rotation center P1 (FIG. 3) of the energy storing cam shaft 29*a* and a fourth sprocket 7*h* is disposed on a straight line 60 (FIG. 3) connecting rotation centers of a rotation axis of the closing shaft 3 and an intermediate shaft 7*e*. In FIG. 2, a rotation center P2 (FIG. 3) of the energy storing cam shaft 29*a* and the fourth sprocket 7*h* is disposed above the straight line 60 connecting rotation centers of the rotation axis of the closing shaft 3 and the intermediate shaft 7*e* (FIG. 3). Details will be described later.

The roller 28 pushes the energy storing cam 29 in the direction opposite to the arrow A, and the stop lever 21 tries to be rotated in the direction opposite to the arrow A. However, the stop lever 21 is restrained from being rotated reversely by a stopper unit 41 fitted to the support structure 4. A configuration of the stopper unit 41 will be described later.

A feed pawl 23 is mounted to the feed lever 20. The feed pawl 23 is disposed so as to be rotatable about the axis extending in parallel to the closing shaft 3 and to be engaged with the outer peripheral teeth 22*a* of the ratchet wheel 22. Further, the feed pawl 23 is always pushed toward the closing shaft 3 from outside in a radial direction by a feed pawl return spring 26*a* so as to be engaged with the outer peripheral teeth 22*a*.

The feed pawl 23 is rotatably mounted to the feed lever 20 and engaged with the outer peripheral teeth 22*a* of the ratchet wheel 22. The feed pawl 23 is always applied with force by the return spring 26*a* in a direction that the feed pawl 23 is engaged with the outer peripheral teeth 22*a*. The direction that the feed pawl 23 is engaged with the outer peripheral teeth 22*a* is a direction that the feed pawl 23 is pushed toward a center axis of the closing shaft 3 from the radial direction outside.

The ratchet wheel 22 is fixed to the closing shaft 3 so as to be rotated together with the closing shaft 3. The ratchet wheel 22 is formed into a disk shape having the plurality of outer peripheral teeth 22*a* on the outer peripheral side surface thereof and a cut part 22*b* having no tooth. The ratchet wheel 22 is firmly fixed to the closing shaft 3 and is rotated, together with the closing cam 14 also firmly fixed to the closing shaft 3, in the direction of the arrow A (FIGS. 1 and 2) about the closing shaft 3.

The first and the second stop pawls 24*a* and 24*b* are mounted, as two stop pawls, so as to be disposed adjacent to each other on the stop lever 21. Each of the first and the second pawls 24*a* and 24*b* are disposed so as to be rotatable about a shaft extending in parallel to the axis (rotation axis) of the closing shaft 3 and to be engaged with the outer peripheral teeth 22*a* of the ratchet wheel 22.

The first and the second stop pawls 24*a* and 24*b* are each mounted to the stop lever 21 so as to be rotatable and to be engaged with the outer peripheral teeth 22*a*. Return springs 26*b* and 26*c* are provided for the first and the second stop pawls 24*a* and 24*b*, respectively, so as to always apply force to the first and the second stop pawls 24*a* and 24*b* in a direction that the first and the second stop pawls 24*a* and 24*b* are each engaged with the outer peripheral teeth 22*a*. The first and the second stop pawls 24*a* and 24*b* are each always pushed toward the closing shaft 3 from the radial direction outside by the first stop pawl return spring 26*b* and the second stop pawl return spring 26*c*, respectively, so as to be engaged with the outer peripheral teeth 22*a*.

The stop lever 21 is coupled to the motor 7 that transmits power for swinging the feed lever 20. The motor 7 serves as a drive force for driving the switchgear operating mechanism and is fixed to the support structure 4 via a spacer 70. The following describes a drive mechanism that transmits the drive force of the motor 7.

A first sprocket 7*b* is firmly fixed to an output shaft 7*a* of the motor 7.

A sprocket base 5 is firmly fixed to the support structure 4 via a spacer 5*a*. The intermediate shaft 7*e* is rotatably disposed on the sprocket base 5. A second sprocket 7*d* and a third sprocket 7*f* are each firmly fixed to the intermediate shaft 7*e*. The fourth sprocket 7*h* is firmly fixed to an end portion of the energy storing cam shaft 29*a*.

A first chain 7*c* is provided so as to be meshed with the first and second sprockets 7*b* and 7*d*. A second chain 7*g* is provided so as to be meshed with the third and the fourth sprockets 7*f* and 7*h*.

When the motor 7 is driven, the output shaft 7*a* is rotated counterclockwise (direction E), thereby causing the first sprocket 7*b* to be rotated. The rotation drive force is transmitted by the first chain 7*c* meshed with the first and the second sprockets 7*b* and 7*c* while being reduced in speed. Further, the third sprocket 7*f* firmly fixed, together with the second sprocket 7*d*, to the intermediate shaft 7*e* is rotated counterclockwise (direction D). The fourth sprocket 7*h* is rotated at a further reduced speed by the second chain 7*g* meshed with the third and the fourth sprockets 7*f* and 7*h*, causing the energy storing cam shaft 29*a* to be rotated. In such a manner, the drive force of the motor 7 is transmitted to the energy storing cam 29.

With the above-described configuration, the drive force of the motor 7 is transmitted to the energy storing cam 29 through the first to fourth sprockets 7*b*, 7*d*, 7*f*, 7*h*, first chain 7*c*, and the second chain 7*g*.

A catch mechanism 11 maintains an energy storing state of the closing spring 1 and releases the maintained energy storing state to cause the closing spring 1 to enter an energy-released state. To realize the above function, the catch mechanism 11 has a configuration engaged with the closing lever 10. Specifically, as illustrated in FIGS. 1 and 2, the catch mechanism 11 includes a solenoid 11*a*, a plunger 11*b*, an engagement lever 11*c*, and a return spring 12.

The solenoid 11*a* is fixed to the support structure 4 and receives a closing command from outside to be excited. The plunger 11*b* presses the engagement lever 11*c* with the excitation of the solenoid 11*a*.

The engagement lever 11*c* is rotatably mounted to the support structure 4 so as to be engaged with a leading end of the plunger 11*b*. The engagement lever 11*c* is applied with spring force by the return spring 12 in a counterclockwise direction, and rotation thereof is restricted by the plunger 11*b*.

A state where the pawl 10*a* and the engagement lever 11*c* are engaged with each other as illustrated in FIG. 2 is a state where the catch mechanism 11 is engaged with the closing lever 10, that is, a state where the closing spring 1 is in the energy storing state. Further, a state where the pawl 10*a* and the engagement lever 11*c* are not engaged with each other as illustrated in FIG. 1 is a state where the catch mechanism 11 is not engaged with the closing lever 10. Thus, in FIG. 1, the closing spring 1 is in the energy-released state.

A link 2 has one end rotatably coupled to the pin 8 firmly fixed to the spring receiver 6 and the other end rotatably coupled to a pin 10*b* firmly fixed to the closing lever 10.

The pin 10*b* is firmly fixed to the closing lever 10 and rotatably coupled to the link 2. The closing spring 1 is disposed between the spring receiver 6 and the support structure 4 so as to be expandable/contractable.

A roller 15*a* is rotatably supported at a leading end of an operation lever 15 having a rotation axis 16 extending in parallel to the closing shaft 3. The roller 15*a* is engaged with the closing cam 14 at closing operation time so as to be contactable and separable relative to the closing cam 14. Rotational movement of the operation lever 15 is used for ON/OFF operation of a cutoff section (not illustrated) of the switchgear.

As described above, in the closing operation of the switchgear operation mechanism according to the present embodiment, the feed pawl 23 is rolled by the drive force of the motor 7 to rotate the ratchet wheel 22, and the rotating ratchet wheel 22 rotates the closing shaft 3 to store energy in the closing spring 1 through the closing lever 10 firmly fixed to the closing shaft 3. By releasing the energy of the closing spring 1 in the energy-stored state, closing operation of the switchgear is achieved.

The following describes a structure of the stopper unit 41 illustrated in FIGS. 1 and 2 with reference to FIGS. 4 and 5. FIG. 4 illustrates a state where a return spring 47 is restored to release its energy (corresponding to the state illustrated in FIG. 2), and FIG. 5 illustrates a state where the return spring 47 is compressed to store its energy therein (corresponding to the state illustrated in FIG. 1).

As illustrated in FIGS. 4 and 5, the stopper unit 41 has a piston plate 40 engaged with the stop lever 21, a piston 42 that can be linearly reciprocated in a predetermined direction with movement of the piston plate 40, a stopper 45 that guides the movement of the piston 42 in the predetermined direction, and the return spring 47 configured to be expandable/contractable.

The stopper 45 is formed so as to have a space (cavity) inside thereof so as to allow the piston 42 to be reciprocated linearly. A bottom portion of the stopper 45 is firmly fixed to the support structure 4 through an elastic body 46 and a spacer 45*a*.

A stop plate 48 is firmly fixed to the stopper 45 by a stop ring 48*c*. A packing 48*a* is provided at a sliding part between the stop plate 48 and the piston 42, and a packing 48*b* is provided at a contact part between the stop plate 48 and the stopper 45. The packing 48*a* and the packing 48*b* are each formed of, e.g., silicon rubber, ethylene-propylene rubber, or the like. The stop plate 48 is formed into a disk shape and has, at a center thereof, a through hole so as to allow one end side of the piston 42 to penetrate therethrough.

The piston 42 is fitted through the cavity of the stopper 45. One end (a first end) side of the piston 42 in a longitudinal direction (a first direction) of the piston 42 is protruded from the through hole and fitted into the piston plate 40 that can contact or separate from the stopper 45.

The piston plate 40 is formed into a disk shape and such that an outer diameter of the disc is larger than an inner peripheral diameter of the cavity of the stopper 45. This allows the movement of the piston 42 in one direction to be stopped by at least the piston plate 40. As illustrated in FIGS. 1 and 2, the piston plate 40 is engaged with the stop lever 21 so as to be contactable and separable relative thereto.

The piston 42 has a hollow cylindrical part extending from a longitudinal direction center portion thereof to the other end (a second end) thereof. The cylindrical part has an outer peripheral diameter larger than an inner diameter of the through hole of the stop plate 48. This allows the movement of the piston 42 in the other direction (a second direction) to be stopped by at least the cylindrical part of the piston 42 around the longitudinal direction center and the stop plate 48.

Further, the piston 42 has a concave part 42*b* at the other end (the second end) side thereof in the longitudinal direction. The concave part 42*b* is disposed so as to be reciprocatable inside the stopper 45. The return spring 47 which is an expandable/contractable elastic body is disposed between the stopper 45 and the piston 42.

A pressurizing chamber 50 is formed in a space surrounded by the concave part 42*b* and the cavity of the stopper 45. Further, a pressure releasing chamber 51 is formed in a space surrounded by side surfaces of the piston 42 other than the concave part 42*b*, the cavity of the stopper 45, and the stop plate 48. Hydraulic oil 49 is encapsulated in the pressurizing chamber 50 and the pressure releasing chamber 51.

The spacer 45*a* is disposed between the stopper 45 and the elastic body 46. The spacer 45*a* allows adjustment of a position of the stop lever 21 in a closing operation completion state and allows a change in a position of the energy storing cam shaft 29*a*.

The piston 42 has a plurality of orifice holes 42*a* formed so as to penetrate through the concave part 42*b* in a circumferential direction thereof. The plurality of orifice holes 42*a* have different hole diameters from each other. The hydraulic oil 49 (fluid) passes through the orifice holes, and resistance force of the fluid passing through the orifice holes 42*a* serves as braking force.

For example, the resistance force of the fluid in the orifice 42*a* having a small hole diameter is larger than that in the orifice 42*a* having a large hole diameter, resulting in large braking force. Further, the larger the total area of the orifice holes (ejection ports), the smaller the resistance force of the fluid becomes, resulting in smaller braking force. Further, the higher an ejection speed of the hydraulic oil 49, the larger the braking force becomes. Thus, by forming the plurality of orifice holes 42*a* and varying the hole diameter among all or some of the orifice holes 42*a*, magnitude of the braking force can be controlled.

In the stopper unit 41, as the piston 42 is moved downward in FIG. 4, the orifice holes 42*a* are closed by an inner peripheral side wall surface of the stopper 45. This reduces the number of the holes and the total area of the ejection port through which the hydraulic oil 49 on the pressuring chamber 50 side is ejected to the pressure releasing chamber 51, resulting in large braking force. Accordingly, the movement speed of the piston 42 is gradually reduced to reduce the ejection speed of the hydraulic oil 49, suppressing an increase in the braking force.

The elastic body 46 is disposed between the support structure 4 and the stopper 45. The elastic body 46 absorbs part of energy caused by force applied to the stopper unit 41 in a direction perpendicular to a surface of the elastic body 46 that contacts the support structure 4. That is, the elastic body 46 serves as a cushioning against impact force to be applied to the stopper unit 41. The elastic body 46 is formed of, e.g., a rubber sheet or low-resilience polymer.

With the above action, the stopper unit 41 can provide substantially constant braking force during the downward movement of the piston 42 in FIGS. 4 and 5. Actually, the braking force includes drag against a compression direction of the return spring 47.

In the process of energy release of the return spring 47 leading to the state illustrated in FIG. 4, the pressurizing chamber 50 and the pressure releasing chamber 51 communicate with each other through the orifice holes 42*a*, as described above. Further, in the process leading to the state illustrated in FIG. 5, the piston 42 is surrounded from outside by the stopper 45 to close the orifice holes 42*a*, blocking the communication state between the pressurizing chamber 50 and the pressure releasing chamber 51.

The thus configured stopper unit 41 checks rotational force of the stop lever 21 in a direction opposite to an arrow B at time of energy releasing operation of the closing spring 1. Further, at time of energy storing operation of the closing spring 1, the stopper unit 41 pushes upward the stop lever 21 along a rotation direction (direction of the arrow B) of the ratchet wheel 22.

(Closing Operation)

The following describes the closing operation of the switchgear operating mechanism according to the present embodiment with reference to FIGS. 1 to 6. FIG. 2 illustrates a state where the closing spring 1 is energy stored, and spring force of the closing spring 1 is maintained by the catch mechanism 11.

In the state illustrated in FIG. 2, the solenoid 11*a* is excited by a closing command from outside to move the plunger 11*b* in a direction of an arrow F. The movement of the plunger 11*b* presses the engagement lever 11*c*, and the engagement lever 11*c* is rotated clockwise (direction of an arrow G). Then, the engagement between the engagement lever 11*c* and the pawl 10*a* is released, with the result that the closing shaft 3 is rotated in the direction of the arrow A by the spring force of the closing spring 1.

In this state, operating force of the closing spring 1 is transmitted to a cutoff section (not illustrated) and a cutoff spring (not illustrated) through the closing cam 14 and the operation lever 15. Then, the cutoff section is closed, and energy is stored in the cutoff spring. In this state, as described above, the stop lever 21 is pushed upward along the rotation direction (direction of the arrow B) of the ratchet wheel 22 by the action of the stopper unit 41.

Subsequently, as the closing operation proceeds, the engagement between the closing cam 14 and the roller 15*a* is released, and thus the closing lever 10 reaches a position (dead center) rotated by about 180 degrees from the position illustrated in FIG. 2 to complete energy storage in the cutoff spring, whereby a load on the closing spring 1 is released.

After release of the load on the closing spring 1, the closing lever 10 is further rotated by inertial force of the closing spring 1 itself, the closing spring 1, the ratchet wheel 22, and the closing cam 14 to reach substantially the position illustrated in FIG. 1, with a rotation speed thereof being reduced while storing energy in the closing spring 1. The closing operation is thus completed.

At a time point when the rotation speed becomes zero, the closing lever 10 is rotated in a direction (counterclockwise direction) opposite to the direction of the arrow A by the stored energy of the closing spring 1. At this time, when the closing lever 10 and the ratchet wheel 22 are rotated in the opposite direction to achieve engagement between the first stop pawl 24*a* or the second stop pawl 24*b* and the outer peripheral teeth 22*a*, the stop lever 21 is rotated in the direction opposite to the arrow A.

When the stop lever 21 being rotated in the direction opposite to the arrow A is engaged with the piston plate 40 of the stopper unit 41, the piston plate 40 is pressed, together with the piston 42, in a direction toward the elastic body 46. At this time, as the operating state transits from the state illustrated in FIG. 4 to that illustrated in FIG. 5, a volume of the pressurizing chamber 50 is reduced with the movement of the piston 42, so that the hydraulic oil 49 in the pressurizing chamber 50 is increased in pressure and thus flows to the pressure releasing chamber 51 side through the plurality of orifice holes 42*a*.

Then, braking force against a movement direction of the piston 42 and the piston plate 40 is generated by the increase in the pressure of the pressurizing chamber 50. This braking force is transmitted to the stop lever 21 engaged with the piston plate 40, the first or the second stop pawl 24*a* or 24*b*, and the outer peripheral teeth 22*a*. As a result, movement of the components connected to the ratchet wheel 22 and the closing shaft 3 is stopped by the braking force.

When the return spring 47 is further compressed by the piston 42 in the course of transition of the operating state from the state illustrated in FIG. 4 to that illustrated in FIG. 5, the orifice holes 42*a* are closed by the stopper 45, as illustrated in FIG. 5. As a result, the number of points through which the hydraulic oil 49 flows from the pressurizing chamber 50 to pressure releasing chamber 51 is reduced, that is, flow-out area of the hydraulic oil 49 is reduced, with the result that the pressure in the pressurizing chamber 50 is maintained at a high level even when the movement speed of the piston 42 is reduced. After that, the piston plate 40 is restrained from being moved further by the stopper 45, whereby the piston plate 40, piston 42, and the components connecting them are stopped.

In a case where the outer peripheral teeth 22*a* are engaged with the feed pawl 23 when the closing lever 10 and the ratchet wheel 22 are reversely rotated to rotate the feed lever 20 in the counterclockwise direction which is the direction opposite to the arrow A, the roller 28 is engaged with the energy storing cam 29, and the stop lever 21 is rotated in the direction opposite to the arrow A. The subsequent action is the same as that described above, so description thereof will be omitted.

The stopper unit 41 having the above-described configuration uses the principle of an oil damper, so that the plurality of orifice holes 42*a* are closed by the stopper 45 with displacement of the piston 42, thereby achieving control of pressure increase based on movement of the hydraulic oil 49.

FIG. 6 illustrates a relationship between the displacement of the stopper unit 41 and a load thereon. FIG. 9 illustrates a relationship between displacement of the stopper unit and a load thereon in the second conventional example, which is exemplified for comparison with FIG. 6. In FIGS. 6 and 9, a horizontal axis represents the displacement, and a vertical axis represents the load.

A shaded area of FIG. 6 represents energy that can be absorbed by the stopper unit 41 according to the present embodiment. A shaded area of FIG. 9 represents energy that can be absorbed by a stopper unit according to the second conventional example. A comparison between FIGS. 6 and 9 reveals that a peak load is smaller in FIG. 6 even when the absorbed energy is the same in FIGS. 6 and 9.

This is because, as described above, the braking force of the stopper unit 41 according to the present embodiment can be controlled by the orifice holes 42*a*. As described above, adequate disposition of the orifice holes 42*a* allows a reduction in the peak load on the stopper unit 41 according to the present embodiment.

(Energy Storing Operation)

The following describes the energy storing operation of the switchgear operation mechanism according to the present embodiment with reference to FIGS. 1 to 5.

FIG. 1 illustrates a state where energy of the closing spring 1 is released. In this state, when the motor 7 is activated, the output shaft 7*a* and the first sprocket 7*b* are rotated counterclockwise (direction of an arrow E). Accordingly, the drive force generated by the rotation is transmitted to the second and the third sprockets 7*d* and 7*f* through the first chain, rotating the second and the third sprockets 7*d* and 7*f* counterclockwise (direction of an arrow D). Further, the drive force is transmitted to the fourth sprocket 7*h* through the second chain 7*g*, rotating the fourth sprocket 7*h* counterclockwise (direction of an arrow C).

As a result, the energy storing cam shaft 29*a* and the energy storing cam 29 are rotated counterclockwise to swing the roller 28 engaged with the energy storing cam 29 along a shape of the energy storing cam 29. Accordingly, the feed lever 20 also starts to swing about the closing shaft 3 to cause the feed claw 23 and the outer peripheral teeth 22*a* to be engaged with each other, thereby rotating the ratchet wheel 22 clockwise (direction of the arrow A). In this state, the first and the second stop claws 24*a* and 24*b* are engaged with the outer peripheral teeth 22*a* so as to prevent reverse rotation of the ratchet wheel 22.

As illustrated in FIG. 2, with the progression of the energy storing operation, the feed pawl 23 reaches the cut part 22*b*. In this state, the closing lever 10 has passed the dead center and is thus rotated in the direction of the arrow A by extending force of the closing spring 1, causing the pawl 10*a* and the engagement lever 11*c* to be engaged with each other. This completes the energy storing operation of the closing spring 1. That is, the energy storing operation of the switchgear operating mechanism according to the present embodiment is completed.

In this state, the spring force of the closing spring 1 is maintained by the engagement lever 11*c*, so that force of the closing spring 1 does not act on the ratchet wheel 22, the feed claw 23, the first stop claw 24*a*, and the second stop claw 24*b*. However, the force of the return spring 47 acts on the stop lever 21 through the piston 42 and the piston plate 40, rotating the stop lever 21 in the direction of the arrow A. However, a movement range of the piston 42 is limited by the stop plate 48 (FIG. 4), so that the piston 42 is stopped after being displaced by a specified amount. A state of the stopper unit 41 illustrated in FIG. 2 corresponds to the state illustrated in FIG. 4.

The following describes a relationship among the rotation axis of the closing shaft 3, rotation axis of the fourth sprocket 7*h*, and the intermediate shaft 7*e* with reference to FIG. 3.

As illustrated in FIG. 3, in energy-releasing operation (corresponding to the state illustrated in FIG. 1) of the closing spring 1 of the switchgear operating mechanism, the rotation center P1 of the energy storing cam shaft 29*a* and the fourth sprocket 7*h* is disposed on the straight line 60 connecting the rotation centers of the rotation axis of the closing shaft 3 and the intermediate shaft 7*e*.

Further, as illustrated in FIG. 3, with the progression of the energy storing operation (corresponding to the state illustrated in FIG. 2) of the switchgear operating mechanism, the stop lever 21 is rotated and, accordingly, the rotation center of the fourth sprocket 7*h* and the energy storing cam shaft 29*a* is moved (rotated) about the rotation axis of the closing shaft 3 from the rotation center P1 to the rotation center P2. An angle formed by a straight line 62, connecting the rotation center P2 of the fourth sprocket 7*h* after the movement of the rotation center and the rotation center of the closing shaft 3, and the straight line 60 is θ1.

As illustrated in FIG. 3, the above rotation of the angle θ1 changes the inter-axis distance between the fourth sprocket 7*h* and the third sprocket 7*f* from L1 to L2. For example, in the second conventional example, the first chain is directly meshed with the first and the fourth sprockets, so that the inter-axis distance between the first and the fourth sprockets is changed by a distance S illustrated in FIG. 3.

A relationship between the change (L2−L1) in the inter-axial distance in the present embodiment and the distance S is represented by S>>(L2−L1), which means that a significant difference is caused in a slack amount of the chain associated with the change in the inter-axis distance. That is, in the present embodiment, the chain slack amount associated with the change in the inter-axis distance can be reduced.

Further, since the energy storing cam 29 and the roller 28 are engaged with each other, the feed lever 20 is rotated in the direction of the arrow A. In this state, as illustrated in FIG. 2, the feed pawl 23 is positioned at the cut part 22*b* and is thus not engaged with the outer peripheral teeth 22*a* in the swing motion caused by the rotation of the energy storing cam 29.

As described above, according to the first embodiment, an oil damper system with the hydraulic oil 49 is used for the stopper unit 41, it is possible to effectively absorb impact force generated when the outer peripheral teeth 22*a* and the pawls (the first stop pawl 24*a*, the second stop pawl 24*b* and the outer peripheral teeth 22*a*) are engaged with each other due to the reverse rotation of the ratchet wheel 22 immediately after the completion of the closing operation, thereby reducing the peak load applied at that time.

As a result, it is possible to prevent the roller 28, the energy storing cam 29, or the ratchet wheel 22 from being damaged to thereby prevent a reduction in the lifetime thereof. Further, it is not necessary to increase strength of the support structure 4 supporting the stopper unit 41 in accordance with the peak load, contributing to a reduction in size of the entire mechanism.

Further, the first and the fourth sprockets 7*b* and 7*h* are not directly connected to each other by a chain. That is, the second and the third sprockets 7*d* and 7*f* are disposed, together with the intermediate shaft 7*e*, between the first and the fourth sprockets 7*b* and 7*h*, and the centers of the intermediate shaft 7*e*, energy storing cam shaft 29*a*, and the rotation axis of the closing shaft are disposed on substantially the same straight line, whereby the drive force of the motor 7 is transmitted by the first and the second chains 7*c* and 7*g*.

Thus, even when the energy storing cam shaft 29*a* swings about the rotation axis of the closing shaft 3, a change in the inter-axis distance between the energy storing cam shaft 29*a* and the intermediate shaft 7*e* is smaller than a distance over which the energy storing cam shaft 29*a* swings, so that it is possible to reduce the slack of the second chain 7*g*. This reduces a possibility that the second chain 7*g* may drop out of the third and the fourth sprockets 7*f* and 7*h*, thereby increasing in reliability of the mechanism. Further, there is eliminated a limitation on the disposition of the motor 7, the motor 7 can be freely disposed at time of layout change of the switchgear operating mechanism, contributing to a reduction in size of the entire mechanism.

Further, according to the first embodiment, the spacer 5*a* is disposed between the sprocket base 5 and the support structure 4 to allow adjustment of distances between the output shaft 7*a* and the intermediate shaft 7*e* and between the output shaft 7*a* and the energy storing cam shaft 29*a* by changing a thickness of the spacer 5*a*. This makes it possible to adjust initial slack of the first and the second chains 7*c* and 7*g*, thereby preventing dropout of the chain.

Further, the spacer 70 is disposed between the motor 7 and the support structure 4 to allow adjustment of a distance between the output shaft 7*a* and the intermediate shaft 7*e* by changing a thickness of the spacer 70. This makes it possible to adjust initial slack of the first chain 7*c*, thereby preventing dropout of the chain.

Further, the spacer 45*a* and the elastic body 46 are disposed between the stopper 45 and the support structure 4 to allow adjustment of the position of the stop lever 21 in the closing operation completion state and to allow a change in the position of the energy storing cam shaft 29*a*. This can change the inter-axis distance between the energy storing cam shaft 29*a* and the intermediate shaft 7*e*, allowing adjustment of the slack of the second chain 7*g*.

Further, the elastic body 46 can absorb impact force acting on the stopper unit 41, thereby allowing a reduction in the peak load. As a result, it is possible to prevent the roller 28, energy storing cam 29, or the ratchet wheel 22 from being damaged to thereby prevent a reduction in the lifetime thereof. Further, it is not necessary to increase strength of the support structure 4 supporting the stopper unit 41 in accordance with the peak load, contributing to a reduction in size of the entire mechanism.

Second Embodiment

Figure 7:
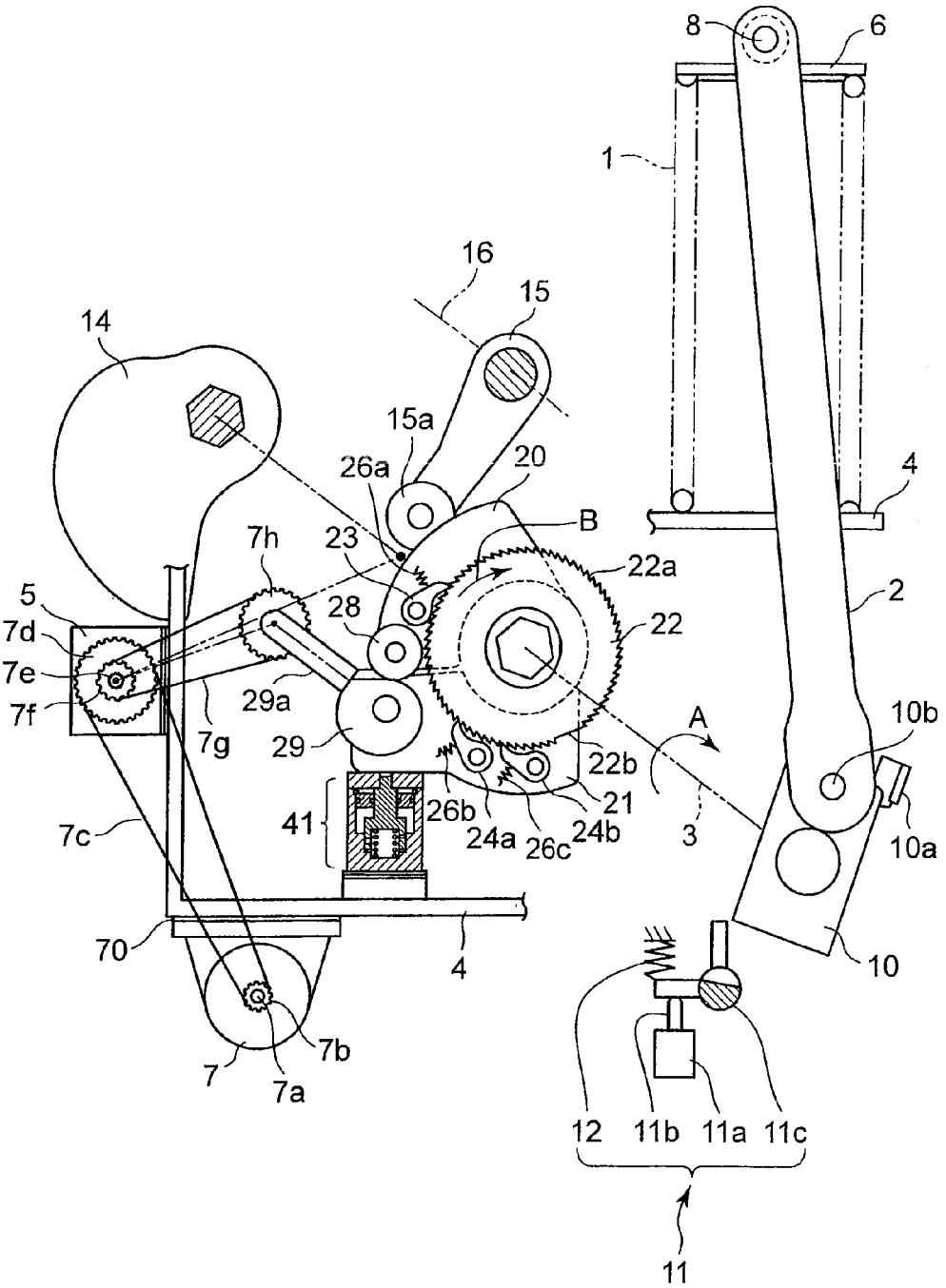
FIG. 7 is a developed front view illustrating the closing operation completion state of the switchgear operating mechanism according to a second embodiment of the present invention.
Figure 8:
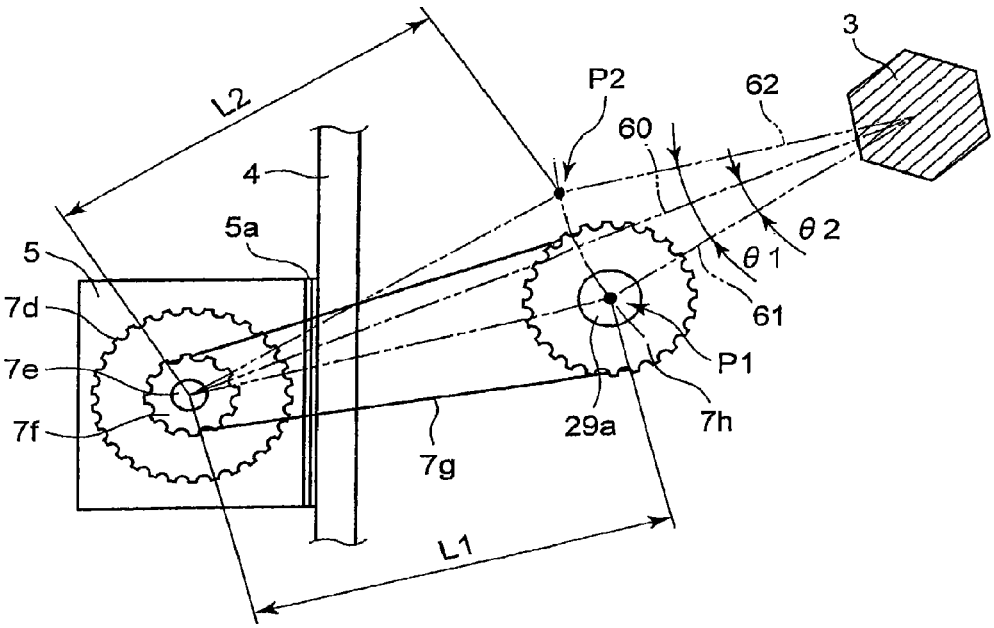
FIG. 8 is a view illustrating the closing shaft, a fourth sprocket and an intermediate shaft part which are illustrated in FIG. 7.

Next, a second embodiment of the switchgear operating mechanism according to the present invention will be described with reference to FIGS. 7 and 8. FIG. 7 is a front view illustrating a part of the switchgear operating mechanism, in a state corresponding to FIG. 1. FIG. 8 is a view illustrating a relative positional relationship among the rotation axis of the closing shaft 3, the energy storing cam shaft 29*a*, and the intermediate shaft 7*e*, in a state corresponding to FIG. 3. Further, a configuration of the stopper unit 41 illustrated in FIG. 7 is the same as those illustrated in FIGS. 4 and 5. In FIGS. 7 and 8, the same reference numerals are given to the same or similar parts in FIG. 6, and redundant descriptions thereof are omitted. Further, in FIG. 8, the closing shaft 3 is illustrated only in a portion of its shaft center, and details thereof, such as the entire shape, are omitted.

In the present embodiment, the configuration in which the rotation center P1 of the fourth sprocket 7*h* is disposed on the straight line 60 connecting the rotation centers (centers of the rotation axes) of the intermediate shaft 7*e* and the closing shaft 3 in the first embodiment illustrated in FIG. 1 is modified.

That is, as illustrated in FIGS. 7 and 8, in the switchgear operating mechanism according to the present embodiment, the rotation center P1 of the fourth sprocket 7*h* is disposed at the stopper unit 41 side with respect to the straight line 60 connecting the rotation centers of the intermediate shaft 7*e* and the closing shaft 3 after completion of the closing operation. On the other hand, the intermediate shaft 7*e* and the rotation center P2 of the fourth sprocket 7*h* after completion of the energy storing operation are disposed as shown in FIG. 8.

Specifically, in the second embodiment, the position of the energy storing cam shaft 29*a* is adjusted by the spacer 45*a* and the elastic body 46 disposed between the stopper 45 of the stopper unit 41 and the support structure 4 and, thereby, the rotation center P1 of the fourth sprocket 7*h* is disposed at the stopper 41 side with respect to the straight line 60.

In FIG. 8, an angle formed by a straight line 61 connecting the rotation center of the closing shaft 3 and the rotation center P1 of the fourth sprocket 7*h*, and the straight line 60 is θ2.

Further, in FIG. 8, an angle formed by the straight line 61 connecting the rotation center of the closing shaft 3 and the rotation center P1 of the fourth sprocket 7*h*, and the straight line 62 connecting the rotation center P2 corresponding to the rotation center P2 of FIG. 3 and the rotation center of the closing shaft 3 is θ1.

After completion of the closing operation of the switchgear operating mechanism, the angle θ2 formed by the straight lines 61 and 60 is, as illustrated in FIG. 8, is substantially half (θ½) of the angle θ1 formed by the straight lines 61 and 62.

In the above configuration, the same function as that in the first embodiment can be obtained. That is, a difference (L2−L1) between an inter-axis distance L1 between the intermediate shaft 7*e* and the rotation center P1 of the fourth sprocket 7*h* after completion of the closing operation, and an inter-axis distance L2 between the intermediate shaft 7*e* and the rotation center P2 of the fourth sprocket 7*h* after completion of the energy storing operation is represented by L2−L1≈0, That means that the inter-axis distance does not change much.

As described above, in the second embodiment, the inter-axis distance hardly changes, so that a possibility that the second chain 7*g* may drop out of the third and the fourth sprockets 7*f* and 7*h* is further reduced. This increases further reliability of the mechanism.

Other Embodiments

While certain embodiments have been described, these embodiments have been presented by way of example only, and are not intended to limit the scope of the inventions. For example, the operating mechanism described above can be applied not only to a switchgear but also to other similar devices. Further, features of the plurality of embodiments can be combined. Indeed, the embodiments described herein may be embodied in a variety of other forms. Furthermore, various omissions, substitutions and changes may be made without departing from the spirit of the inventions. The accompanying claims and their equivalents are intended to cover such forms or modifications as would fall within the scope and spirit of the inventions.

In the above description, symbols illustrated in drawings are as follows:

1: closing spring
2: link
3: closing shaft
4: support structure
5: sprocket base
5*a*: spacer
6: spring receiver
7: motor
7*a*: output shaft
7*b*: first sprocket
7*c*: first chain
7*d*: second sprocket
7*e*: intermediate shaft
7*f*: third sprocket
7*g*: second chain
7*h*: fourth sprocket
8: pin
10: closing lever
10*a*: pawl
10*b*: pin
11: catch mechanism
11*a*: solenoid
11*b*: plunger
11*c*: engagement lever
12: return spring
14: closing cam
15: operation lever
15*a*: roller
16: rotation axis
20: feed lever
21: stop lever
22: ratchet wheel
22*a*: outer peripheral tooth
22*b*: cut part
23: feed pawl
24*a*: first stop pawl
24*b*: second stop pawl
25: return spring
26*a*: return spring
26*b*: return spring
26*c*: return spring
28: roller
29: energy storing cam
29*a*: energy storing cam shaft
40: piston plate
41: stopper unit
42: piston
42*a*: orifice hole
42*b*: concave part
45: stopper
45*a*: spacer
46: elastic body
47: return spring
48: stop plate
48*a*: packing
48*b*: packing
48*c* stop ring
49: hydraulic oil
50: pressurizing chamber
51: pressure releasing chamber
60, 61, 62: straight line
70: spacer

What is claimed is:

1. A switchgear operating mechanism for reciprocatively driving a movable contact of a switchgear so as to shift the switchgear between a cutoff state and a closed state, the switchgear operating mechanism comprising:

a support structure;

a closing shaft extending in a first rotation axis direction to be rotatably supported by the support structure;

a ratchet wheel having substantially a disk-like shape, having a plurality of outer peripheral teeth formed along an outer peripheral side surface thereof and fixed to the closing shaft to be rotated together with the closing shaft;

a feed lever having a plate-like shape, juxtaposed to the ratchet wheel in an axial direction thereof so as to be swingable about the closing shaft in a peripheral direction and provided with, near an outer periphery thereof, a feed lever roller rotatable about a second rotation axis extending in parallel to the closing shaft;

a stop lever having a plate-like shape, juxtaposed to the feed lever in the first rotation axis direction so as to be swingable about the closing shaft in a peripheral direction and provided with, near an outer periphery thereof, an energy storing cam rotatable about an energy storing cam shaft extending in parallel to the closing shaft, the energy storing cam being contactable with a periphery of the feed lever roller;

a motor fixed to the support structure and configured to transmit power for swinging the feed lever;

a feed pawl fixed to the feed lever so as to be engageable with the outer peripheral teeth and configured to transmit the power from the motor to the ratchet wheel to rotate the ratchet wheel and the closing shaft in at least one direction;

a plurality of stop pawls fixed to the stop lever and engaged with the ratchet wheel so as to prevent the ratchet wheel and the closing shaft from being rotated in a reverse direction to the one direction;

a closing spring configured to be expanded/contracted with rotation of the closing shaft;

a closing lever fixed to the closing shaft and configured to have the closing spring expand/contract by rotation of the closing shaft;

a catch mechanism configured to maintain an energy storing state of the closing spring;

a closing cam fixed to the closing shaft to be rotated together with the closing shaft;

a first sprocket fixed to an output shaft of the motor;

a sprocket base fixed to the support structure;

an intermediate shaft rotatably supported by the sprocket base;

a second sprocket fixed to the intermediate shaft so as to be rotatable together with the intermediate shaft;

a third sprocket fixed to the intermediate shaft so as to be rotatable together with the intermediate shaft;

a fourth sprocket rotatably fixed to the energy storing cam shaft;

a first chain meshed with the first and the second sprockets; and a second chain meshed with the third and the fourth sprockets.

2. The switchgear operating mechanism according to claim 1, wherein centers of the first rotation axis, the energy storing cam shaft, and the intermediate shaft are positioned on substantially the same straight line at time of energy storing operation of the closing spring after completion of closing operation of the switchgear.

3. The switchgear operating mechanism according to claim 1, wherein a spacer is disposed between the motor and the support structure.

4. The switchgear operating mechanism according to claim 1, wherein a spacer is disposed between the sprocket base and support structure.

5. The switchgear operating mechanism according to claim 1, further comprising:

a stopper unit fixed to the support structure so as to be held between the stop lever and the support structure and configured to be engaged with the stop lever to prevent rotation of the stop lever, wherein the stopper unit includes:

a piston plate engaged with the stop lever;

a piston having a first end to which the piston plate is fixed and a second end being freely contactable/separable and configured to be reciprocated between the stop lever and the support structure in a manner engageable with the stop lever;

a stopper having a cavity inside thereof, fixed to the support structure and accommodating the piston in the cavity so as to guide movement of the piston;

a stop plate fitted into the stopper so as to limit a movement range of the reciprocating movement of the piston; and a return spring disposed between the piston and the stopper to bias the piston in one direction, and hydraulic oil is encapsulated in a space surrounded by the piston, the stopper, and the stop plate.

6. The switchgear operating mechanism according to claim 5, wherein a concave part is formed at the second end side of the piston, a plurality of orifice holes are formed so as to allow a pressurizing chamber formed by being surrounded by an inner peripheral side of the concave part and the stopper, and a pressure releasing chamber formed by being surrounded by an outer peripheral side of the concave part, the piston, the stopper, and the stop plate, to communicate with each other at the reciprocating movement position at which the piston plate fixed to the first end of the piston and the stop plate are separated farthest from each other, and the encapsulated hydraulic oil can flow in and out between the pressurizing chamber and the pressure releasing chamber through any of the orifice holes during the reciprocating movement of the piston.

7. The switchgear operating mechanism according to claim 5, wherein at least one of a spacer and an elastic body is disposed between the stopper unit and the support structure.

8. The switchgear operating mechanism according to claim 5, wherein at a time of energy storing operation of the closing spring after completion of closing operation of the switchgear, the energy storing cam shaft of the energy storing cam is disposed at the stopper side with respect to a first straight line connecting the first rotation axis of the closing shaft and the intermediate shaft.

9. The switchgear operating mechanism according to claim 8, wherein a first angle formed by a first straight line connecting the first rotation axis of the closing shaft at the time of energy storing operation of the closing spring after completion of closing operation of the switchgear and the intermediate shaft and a second straight line connecting the first rotation axis of the closing shaft and the energy storing cam shaft of the energy storing cam is substantially half of a second angle formed by a third straight line connecting the first rotation axis of the closing shaft in an energy storage completion state of the closing spring and the second straight line.

10. A switchgear comprising:

a movable contact that can be moved in a reciprocating manner, and an operating mechanism that reciprocatively drives the movable contact and configured to be shifted between a cutoff state and a closed state by the movement of the movable contact, the operating mechanism including:

a support structure;

a closing shaft extending in a first rotation axis direction to be rotatably supported by the support structure;

a ratchet wheel having substantially a disk-like shape, having a plurality of outer peripheral teeth formed along an outer peripheral side surface thereof and fixed to the closing shaft to be rotated together with the closing shaft;

a feed lever having a plate-like shape, juxtaposed to the ratchet wheel in an axial direction thereof so as to be swingable about the closing shaft in a peripheral direction and provided with, near an outer periphery thereof, a feed lever roller rotatable about a second rotation axis extending in parallel to the closing shaft;

a stop lever having a plate-like shape, juxtaposed to the feed lever in the first rotation axis direction so as to be swingable about the closing shaft in a peripheral direction and provided with, near an outer periphery thereof, an energy storing cam rotatable about an energy storing cam shaft extending in parallel to the closing shaft, the energy storing cam being contactable with a periphery of the feed lever roller;

a motor fixed to the support structure and configured to transmit power for swinging the feed lever;

a feed pawl fixed to the feed lever so as to be engageable with the outer peripheral teeth and configured to transmit the power from the motor to the ratchet wheel to rotate the ratchet wheel and the closing shaft in at least one direction;

a plurality of stop pawls fixed to the stop lever and engaged with the ratchet wheel so as to prevent the ratchet wheel and the closing shaft from being rotated in a reverse direction to the one direction;

a closing spring configured to be expanded/contracted with rotation of the closing shaft;

a closing lever fixed to the closing shaft and configured to have the closing spring expand/contract by rotation of the closing shaft;

a catch mechanism configured to maintain an energy storing state of the closing spring;

a closing cam fixed to the closing shaft to be rotated together with the closing shaft;

a first sprocket fixed to an output shaft of the motor;

a sprocket base fixed to the support structure;

an intermediate shaft rotatably supported by the sprocket base;

a second sprocket fixed to the intermediate shaft so as to be rotatable together with the intermediate shaft;

a third sprocket fixed to the intermediate shaft so as to be rotatable together with the intermediate shaft;

a fourth sprocket rotatably fixed to the energy storing cam shaft;

a first chain meshed with the first and the second sprockets; and a second chain meshed with the third and the fourth sprockets.

* * * * *